United States Patent [19]

Lauener et al.

[11] Patent Number: 4,567,933

[45] Date of Patent: Feb. 4, 1986

[54] DEVICE FOR MANUFACTURING METAL STRIPS

[75] Inventors: Wilhelm F. Lauener, Gerlafingen; Rolf Würgler, Esslingen, both of Switzerland

[73] Assignee: Swiss Aluminium Ltd., Chippis, Switzerland

[21] Appl. No.: 540,780

[22] Filed: Oct. 11, 1983

[30] Foreign Application Priority Data

Oct. 18, 1982 [CH] Switzerland ..... 6070/82

[51] Int. Cl.[4] ..... B22D 11/06

[52] U.S. Cl. ..... 164/428; 164/442; 164/448

[58] Field of Search ..... 164/441–442, 164/447–448, 484, 480, 428; 72/245

[56] References Cited

U.S. PATENT DOCUMENTS 3,550,675 12/1970 Hess et al. ..... 164/442
3,752,219 8/1973 Burkhardt et al. ..... 164/448
4,095,448 6/1978 Gipperich ..... 72/245
4,131,154 12/1978 Vial et al. ..... 164/442

FOREIGN PATENT DOCUMENTS 0006375 1/1980 European Pat. Off. ..... 164/448

*Primary Examiner*—Nicholas P. Godici
*Assistant Examiner*—Richard K. Seidel
*Attorney, Agent, or Firm*—Bachman & LaPointe

[57] ABSTRACT

A device for manufacturing metal strips by the roll casting process and having at least two rolls mounted in bearings in supporting frames is such that the supporting frames (5*a* and 5*b*) are connected by pre-tensioning facilities (E) each of which comprises a hydraulically or pneumatically powered cylinder-piston system. The said pre-tensioning facilities are mounted at one end on a pedestal base (10) running under the frame (5*b*) and at the other end on a cross beam (15) extending over the other supporting frame (5*a*).

12 Claims, 2 Drawing Figures

DEVICE FOR MANUFACTURING METAL STRIPS

BACKGROUND OF THE INVENTION

The invention relates to a device for manufacturing metal strips, in particular aluminium strips produced by continuous casting between rolls, said device featuring at least two rolls mounted in supporting frames; the invention also relates to a process for changing these rolls.

Known strip casting machines feature at least two rolls which form a roll gap between them into which the molten metal is fed. The rolls are mounted at their ends in supporting frames which accommodate between them an adjusting facility by means of which the distance between the supporting frames and with that the size of the roll gap can be determined. These supporting frames are in turn enclosed in a rigid frame of the casting machine.

After a certain time the surface of the rolls suffer wear which makes it necessary to change the rolls and re-grind the surface. In the case of conventional roll type continuous casters this involves removing the rolls from the supporting frames or bearings which are mounted in the machine frame. This is done by drawing the casting rolls sideways out of the supporting frame. For this reason sufficient space must be kept free at the side of the casting machine.

SUMMARY OF THE INVENTION

The object of the present invention is therefore to develop a roll type casting machine which dispenses with the rigid machine frame and, in particular with respect to handling, is much more flexible. As such this device should make it easier to set the roll gap and should realize a process for changing the rolls much faster, at the same time requiring much less space.

This object is achieved by way of the invention in which a device of the kind described above features supporting frames connected by pre-tensioning facilities.

Consequently the rigid machine frame known up to now is redundant. It is replaced by an adjustable pre-tensioning facility which at one end is mounted on a pedestal base running under the supporting frame and at the other end on a cross beam extending over the supporting frame. An essential step in the invention is that this pre-tensioning facility can be varied in its length. In accordance with the invention most suitable for this purpose is a hydraulically or pneumatically powered cylinder-piston system, as this is simplest in construction and would seem accordingly to be least susceptible to breaking down.

BRIEF DESCRIPTION OF THE DRAWINGS

Further advantages, features and details of the invention are revealed in the following description of a preferred exemplified embodiment of the invention and with the aid of the drawings viz.

DETAILED DESCRIPTION

Figure 1:
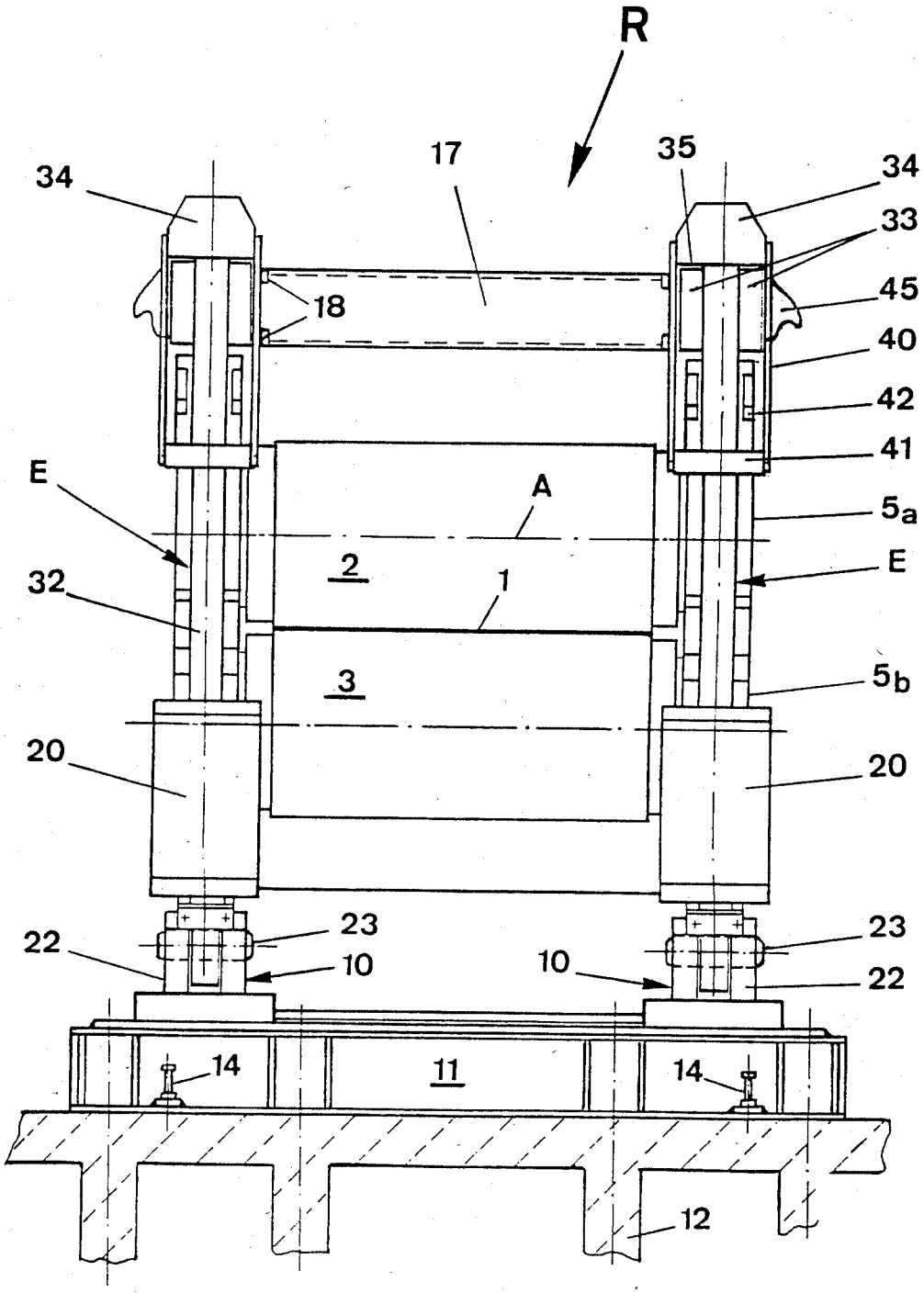
FIG. 1 Front elevation of a continuous roll casting device.

In the preferred embodiment the cylinder is mounted, hinged on the pedestal base, while the piston rod connected to the piston rests on the cross beam when in service, the connection to the cross beam being easy to release when this is required. Of course this connection can also be arranged the other way round. Easy-to-release means in this context that in service the piston rod is connected to the cross beam without any special securing means.

The hinge connection between the cylinder and the pedestal base is achieved in a simple manner in that a tongue is provided on the cylinder and the said tongue fits into a fork formed by the pedestal base and is held there by a bolt.

The piston rod on the other hand terminates in a hammer shaped head which, in service, rests on the cross beam. The end of the cross beam is preferably also in the form of a fork, the prongs of which lie on opposite sides of the piston rod. In this version the hammer shaped head lies on the prongs. By employing the hydraulic mechanism of the pretensioning facility the supporting frame can therefore be clamped firmly in place.

In order to improve the holding of the hammer head on the cross beam, the invention makes provision for the hammer head to feature on its lower side, i.e. the surface lying on the beam, a bar which is hemispherical in cross section and which engages in a corresponing recess in the cross beam. As a result any unintentional slipping of the hammer head is avoided when operating the hydraulic mechanism.

This arrangement permits very flexible operation of the whole roll casting unit, as the whole cylinder piston system can be tilted outwards on the bolts when it is relaxed. Access to the rolls if desired, is thus considerably simplified. As such the invention provides for both of the supporting frames with respect to each other and the connection from supporting frames to the cross beam or pedestal base to be of a non-rigid construction.

For roll-changing purposes it should be possible, after tilting away the pre-tensioning facilities, to separate the cross beam from the supporting frame and the individual supporting frames from each other. To this end the invention provides for the supporting frame to feature location pins which can be inserted in the cross beam. This arrangement permits simple removal of the cross beam, for example using an overhead crane, and also permits accurate centering of the cross beam when it is mounted into place. Corresponding location pins are also provided for joining the supporting frame to the pedestal base.

To limit the stroke of the piston, the piston rod features a stop bar which strikes against a stop plate fixed to the supporting frame. Further stop plates which can accomodate parts of a lifting means are provided on the cross beam.

On changing rolls the whole pre-tensioning facility is relaxed by decompressing the hydraulic system, and the individual cylinder-piston systems tilted outwards. As a result the upper supporting frame is usually free to be removed by a crane. This is removed together with the roll in line with the direction of casting so that it is no longer necessary to reserve space for this at the side of the casting machine. The lower frame is removed in the same manner. Immediately afterwards reserve supporting frames with already accurately calibrated rolls can be installed in the casting machine. This results in a considerable saving of time as the work of exactly aligning the rolls in the bearings, which remain in the supporting frame, is eliminated. Following this, the cross beam is set into place and the pre-tensioning facilities are tilted back into position. The casting machine is again ready for operation within the shortest possible time.

Specifically referring to the drawings, molten metal flowing from a nozzle, not shown here, is introduced into the gap 1 between two rolls 2 and 3 of a roll type casting device R. These rolls turn, counter to each other in accordance with a drive mechanism which is not shown; as a result the metal is cooled and emerges from the roll gap 1 in strip form.

The rolls 2 and 3 turn in bearing facilities 4 (FIG. 2) which are situated in supporting frames 5*a* and 5*b*. The frames 5*a*, 5*b* feature corner recesses 7*a* and 7*b* on their facing sides 6*a* and 6*b* which house components 8*a* and 8*b* for adjusting a distance a between the two frames 5*a* and 5*b*. These components can be spacer plates or a device such as is described in copending U.S. patent application Ser. No. 540,779, for DEVICE FOR ADJUSTING THE WIDTH OF THE GAP BETWEEN THE ROLLS OF A CONTINUOUS CASTING FACILITY, By Bruno Frischknecht et al., filed of even date herewith.

The frames 5*a* and 5*b* lie one above the other with frame 5*b* mounted, releaseably via location pins 9, on a pedestal 10 which is in turn connected via an I beam 11 to foundations 12 or the like by securing means 14.

Mounted on the frame 5*a* is a cross beam 15, the position of which is determined by further location pins 16. Two opposite lying cross beams 15 at the same level are joined by a cross girder 17 lying parallel to a rolling axis A (FIG. 1). This girder 17 is attached to the cross beams 15 by means of bolts 18.

On each side of the frames 5*a* and 5*b* is a pre-tensioning facility E comprising a hydraulically or pneumatically driven piston-cylinder system with a tongue 21 on the cylinder 20; the tongue 21 is accommodated in a fork 22 on pedestal 10. Fork 22 and tongue 21 together with bolt 23 form a hinged connection which allows the pre-tensioning facility E to be tilted in direction x.

Figure 2:
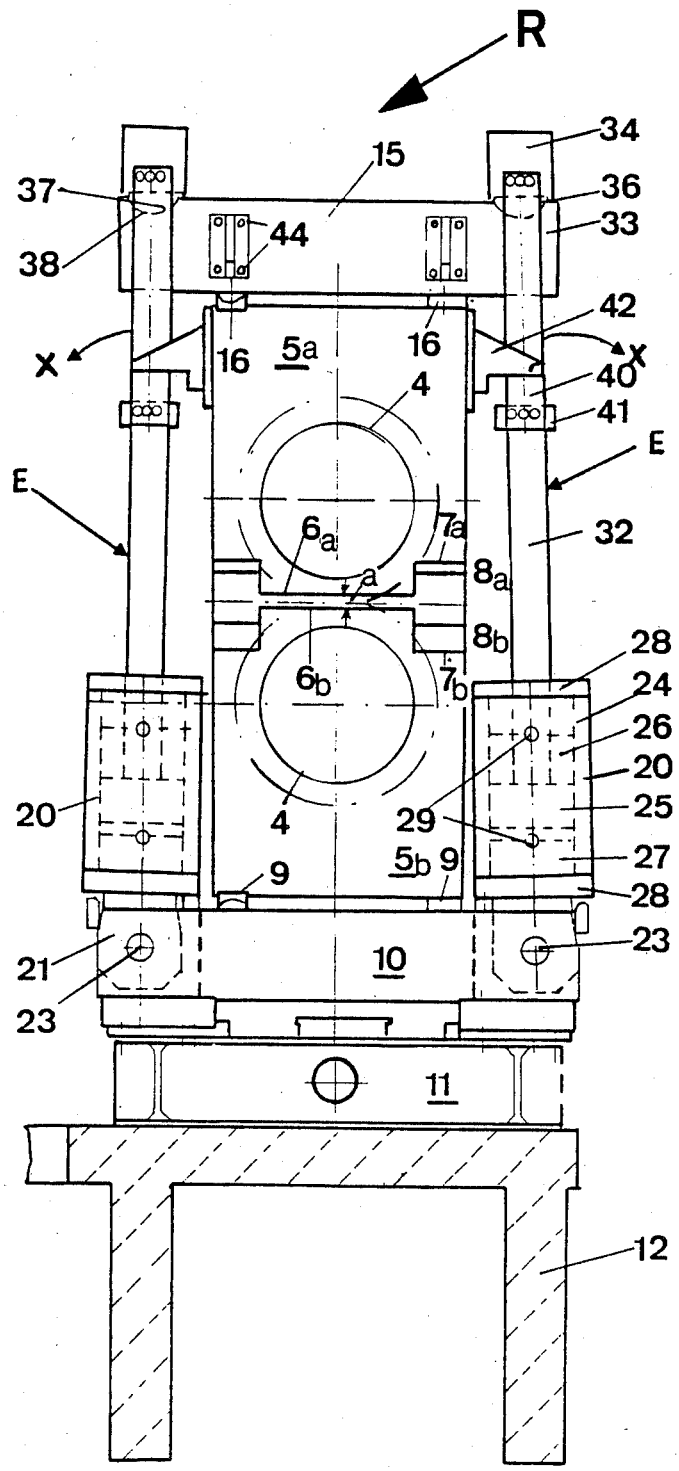
FIG. 2 An end view of the device shown in FIG. 1.

A bore 24 in cylinder 20, in broken lines in FIG. 2, is divided by piston 25 into two chambers 26 and 27 which are sealed off at the ends by cylinder heads 28. Each chamber 26 and 27 is connected via an opening 29 to a hydraulic or pneumatic system supply line, not shown here.

Projecting out from piston 25 is a piston rod 32 which can be introduced into the fork 33 formed by the cross beam 15. Towards its end the piston rod 32 features a hammer shaped head 34 with a, in cross section, hemispherical shaped bar 36, the curved surface 37 of which engages in a correspondingly shaped recess 38 in fork 33 when the device is in the closed position.

Secured to both sides of the hammershaped head 34 are strips 40 which extend down the piston rod 32 and are connected to a stop bar 41 at about the level of roll 2. This stop bar 41 butts against stop plates 42 which project out from frame 5*a* on opposite sides of the piston rod 32.

Bolted on to the cross beam 15 by bolts 44 are fixtures 45 which a lifting means, not shown here, can engage with to remove the cross beam facility.

What is claimed is:

1. Device for manufacturing metal strips produced by continuous casting between rolls which comprises at least two rolls, supporting frames mounting said rolls including a lower supporting frame for the lower roll and an upper supporting frame for the upper roll, a base running below said lower frame and a cross beam extending over the upper frame, pre-tensioning facilities connecting said base to the cross beam wherein said pre-tensioning facility can be varied in length, and wherein the pre-tensioning facility includes a piston system including a piston mounted in a cylinder with the cylinder hinged to the base, wherein said pre-tensioning facility is operative to tilt whereby when changing the rolls the pre-tensioning facility tilts away and the roll is changed together with its supporting frame.

2. Device according to claim 1 for manufacturing aluminum strips.

3. Device according to claim 1 wherein said piston system is a hydraulic cylinder piston system.

4. Device according to claim 1 wherein said piston system is a pneumatic cylinder piston system.

5. Device according to claim 1 including a piston rod connected to the piston and releasably connected to the cross beam.

6. Device according to claim 5 wherein the cylinder includes a tongue which is accommodated in a fork at the end of the base, with tongue and fork being connected by a bolt.

7. Device according to claim 5 wherein the piston rod includes towards its end a hammer shaped head which in service rests on the cross beam.

8. Device according to claim 7 wherein a bar which is hemispherical in cross section, is formed out of the bottom of the hammer head and in service engages in a recess in the cross beam.

9. Device according to claim 1 wherein the upper frame includes location pins which can be introduced into the cross beam and by means of which the cross beam can be centered.

10. Device according to claim 9 wherein the lower frame is releasably connected to the base by means of location pins.

11. Device according to claim 1 including a stop plate on the upper frame and a stop bar on the pre-tensioning facility wherein said stop plate strikes said stop bar.

12. Device according to claim 1 wherein the cross beam inclueds means for engaging with parts of a lifting means.

* * * * *